US005130696A

United States Patent [19]

Liebman

[11] Patent Number: 5,130,696

[45] Date of Patent: Jul. 14, 1992

[54] SOUND-GENERATING CONTAINMENT STRUCTURE

[75] Inventor: Theodore Liebman, Philadelphia, Pa.

[73] Assignee: PepsiCo Inc., Purchase, N.Y.

[21] Appl. No.: 660,538

[22] Filed: Feb. 25, 1991

[51] Int. Cl.[5] ..... G08B 21/00

[52] U.S. Cl. ..... 340/540; 340/384 E; 340/692; 84/94.2

[58] Field of Search ..... 340/540, 384 E, 568, 340/570, 692; 446/175, 397; 272/27 N; 84/95.1, 95.2, 94.1, 94.2

[56] References Cited

U.S. PATENT DOCUMENTS

| | | | |
|---|---|---|---|
| 2,792,737 | 5/1957 | Sheridan | 84/94.2 |
| 3,292,610 | 12/1966 | Newman | 600/27 |
| 4,163,120 | 7/1979 | Baumwolspiner | 381/51 |
| 4,242,670 | 12/1980 | Smith | 340/568 |
| 4,341,230 | 7/1982 | Siahou | 434/263 |
| 4,678,093 | 7/1987 | Allen | 215/11.1 |
| 4,702,140 | 10/1987 | Goldfarb | 84/609 |
| 4,801,929 | 1/1989 | Instance | 340/384 E |
| 4,866,807 | 9/1989 | Kreit et al. | 15/105 |

FOREIGN PATENT DOCUMENTS

| | | | |
|---|---|---|---|
| 767821 | 9/1967 | Canada | 340/568 |
| 2703030 | 7/1978 | Fed. Rep. of Germany | 340/568 |

*Primary Examiner*—Jin F. Ng
*Assistant Examiner*—Christine K. Oda
*Attorney, Agent, or Firm*—Scully, Scott, Murphy & Presser

[57] ABSTRACT

An arrangement for the generating or producing of sounds and, more particularly, a containment structure incorporating a sound-generating device which will be activated upon opening of the container structure so as to emit a preprogrammed sequence of sounds. In a more specific aspect, the containment structure may be constituted of a sealed beverage can; for instance, of the type which is widely distributed in the so-called soft drink or carbonated beverage industry, wherein the containment structure incorporates at least one compartment containing a sound-generating and emitting device which is activated upon the opening of the containment structure.

15 Claims, 2 Drawing Sheets

SOUND-GENERATING CONTAINMENT STRUCTURE

BACKGROUND OF THE INVENTION

1. Field of the Invention

The present invention relates to an arrangement for the generating or producing of sounds and, more particularly, pertains to a containment structure incorporating a sound generating device which will be activated upon opening of the container structure so as to emit a preprogrammed sequence of sounds. In a more specific aspect, the containment structure may be constituted of a sealed beverage can; for instance, of the type which is widely distributed in the so-called soft drink or carbonated beverage industry, wherein the containment structure incorporates at least one compartment containing a sound-generating and emitting device which is activated upon the opening of the containment structure.

A containment structure, such as a beverage can or other kind of enclosure, incorporating a sound generating-device therein, may find numerous and diverse applications in commerce and industry, particularly when it is contemplated to utilize the device in connection with a promotional or sales campaign concerning the particular product and/or manufacturer, industry or organization which is represented by the containment structure; for example, as it relates to and promotes the sale of a "soft drink" or carbonated beverage. Hereby, the opening of a dispensing closure on the beverage can, the latter of which may be a promotional can which might possibly look different from a normal beverage can by a consumer who may be unaware that the contents of the beverage can incorporates a sound-generating and emitting device representing a promotional theme, which is embodied in a sequence of sounds providing a synthesis of a musical score or so-called "jingle" and/or a human voice imparting a message to the consumer; for instance, that the purchaser is the potential recipient of a prize or of some premium awarded by the manufacturer of this particular product. Hereby, when applicable, the containment or beverage can may be returned to the retail establishment or vendor by the purchaser in order to claim any prize or premium which may have been voiced through the message received from the sound-generating device.

The sound-generating device, which is activated upon the opening of a closure on the containment structure, such as a pull tab arranged on a beverage can as is well-known in the soft drink or beverage industry, may incorporate a suitable battery-powered speech processor chip having a circuit containing a memory (stored message) and logic and playback circuit, and with the installation of suitable filters, amplifiers, and a speaker for emitting electronically-generated sounds synthesizing human voice or musical instrument characteristics. In view of different prize quantities and premiums which may be imparted to various promotional cans, different speech systems may be incorporated in the sound-generating devices. By way of example only, one system may include a microcomputer possessing a speech compression circuit and recording in addition to the other above-mentioned circuitry components. The sound-generating device may be activated through the intermediary of a light-actuated switch arrangement; for instance in the configuration of either a photosensitive resistor, or photo transistor, or Photo-Darlington which is responsive to ambient light of even the lowest intensity entering the beverage can through the opened closure.

Furthermore, the container or beverage can may also include a second sealed compartment, in addition to the compartment housing the sound-generating device, and assuming the remaining internal space of the beverage can, which, if desired may be filled with a non-toxic and harmless liquid, such as water or the like, or some other weighted structure, in order to impart to the initially sealed beverage can the feel and weight of a normal, full beverage can.

2. Discussion of the Prior Art

Although various types of containment structures and arrangements, such as toys and the like, which incorporate sound-generating and voice synthesizing devices are known in the art, which may be mechanical, electromechanical or electronic in construction, none of these devices disclose a containment structure, particularly such as a beverage can, which possesses a light-actuated sound-generating device for emitting a specified programmed sound, such as a musical and/or voice sequence, for a predetermined time interval in response to the opening of the beverage can.

In essence, Allen U.S. Pat. No. 4,678,093 discloses a musical baby bottle including a mercury switch adapted to selectively activate a sound-generating microchip device in dependence upon the physical orientation of the baby bottle during its use by an infant. Hereby, the entire sound-generating system, consisting of the microchip, speaker, a battery and switch, all located with the baby bottle, is inaccessible from the exterior of the base section of the bottle, and the sound-generating components are activated in response to the tilting orientation of the baby bottle.

Kreit, et al. U.S. Pat. No. 4,866,807 disclose a toothbrush incorporating an electronic sound-generating arrangement, including a battery-powered microcomputer and speaker, activated in response to the depression of a push-button during the handling of the toothbrush. There is no disclosure or concept of having a light-activated sound-generating device arranged within a container, such as a carbonated beverage can, analogous to that contemplated by the present invention.

Siahou U.S. Pat. No. 4,341,230 relates to a toothbrush which, in response to the brushing action of the toothbrush against teeth, will provide for an electrical contact with a switch in order to activate a sound-generating arrangement located within the handle of the toothbrush. There is no disclosure nor suggestion of employing a light-activated electronic sound-generating device which is housed within a closed containment structure, such as a carbonated beverage can, and in which sound simulating-music or a voice is generated in response to light entering through an openable closure in the containment structure.

Goldfarb U.S. Pat. No. 4,702,140 discloses a solar-powered musical ornament, including a microprocessor activated by a solar cell or cells mounted on the ornament, and wherein the exposure of the solar cell to light will continually generate electrical current to power a microprocessor of the sound-generating device. There is no structure or function analogous to the activating of an electronic sound-generating device contained in a closed container, such as a carbonated beverage can, and in which the opening of a can closure will cause a light-actuated switch for instance, through a photosensitive resistor, to activate the sound-generating device so as to emit programmed sounds for a predetermined interval of time.

SUMMARY OF THE INVENTION

Accordingly, it is an object of the present invention to provide in a closed containment structure; for example, such as a can for carbonated beverages or the like, a sound generating device which is activated upon opening of the containment structure through the intermediary of a light-actuated switching device in response to ambient light impinging against the latter.

A more specific object of the present invention resides in the provision of a structure of the type described herein, in which activating of the sound-generating device contained in the containment structure is effectuated by a switch upon opening of a container closure by means of either a photosensitive resistor, photo transistor or photo darlingtor which is operatively responsive to ambient light entering the container.

A further object of the present invention resides in the provision of a container incorporating the inventive sound-generating device, and which possesses the weight, appearance and feel of a regular, ordinarily beverage-filled can.

Yet another object of the present invention resides in the provision of a container of the type described herein and incorporating a sound-generating device and a compartment with a non-toxic liquid, in which the entire device located within the container is sealed relative to the exterior thereof so as to preclude potential harm to a consumer by the contents of the container upon opening of the container.

BRIEF DESCRIPTION OF THE DRAWINGS

The foregoing features and other objects and advantages of the invention may now be more readily ascertained from the following detailed description of a preferred embodiment thereof, taken in conjunction with the accompanying drawings; in which.

DETAILED DESCRIPTION

Figure 1:
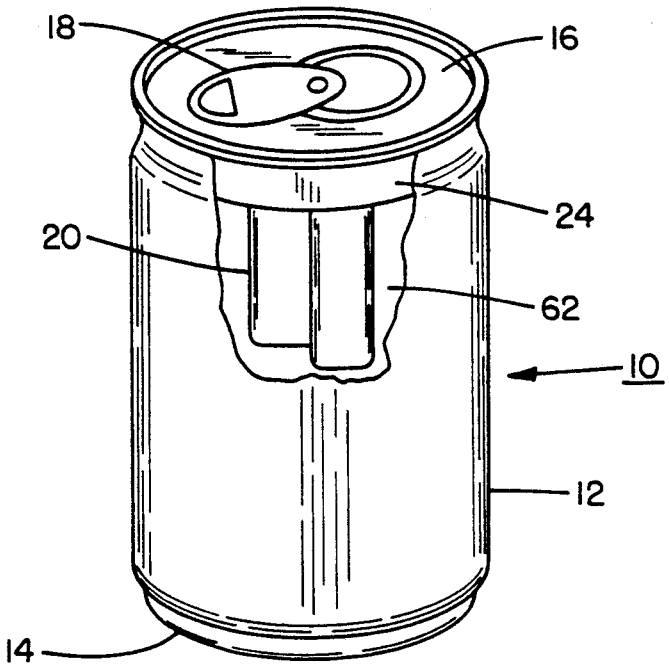
FIG. 1 illustrates, partly in section, a perspective view of a container, such as a beverage can, incorporating the sound-generating device pursuant to the invention.

Reverting now in greater particularity to the drawings, FIG. 1 illustrates a containment structure 10 which, in this instance, may consist of a can for a carbonated beverage possessing a cylindrical side wall 12, a bottom wall 14, and a top wall or lid 16 incorporating a typical openable pull-tab closure 18, or similar can-opening structure, as is widely employed in the beverage can industry. Hereby, the cylindrical can, bottom wall and/or lid may be constituted from a metallic, plastic or liquid-impermeable paperboard material or from combinations of such materials, as desired. The cylindrical surface 12, and if desired, the bottom wall and/or top wall surfaces, may be provided with suitable decorative indicia and logos identifying the product and manufacturer, as well as imparting further consumer-oriented information over the contents of the beverage can.

Housed within the confines of the container or beverage can 10 is the sound-generating device 20 pursuant to the invention, preferably fastened to the internal surface of the cover wall 16 so as to provide a fluid-tightly sealed compartment arrangement for receiving the components of the sound-generating device.

Figure 2:
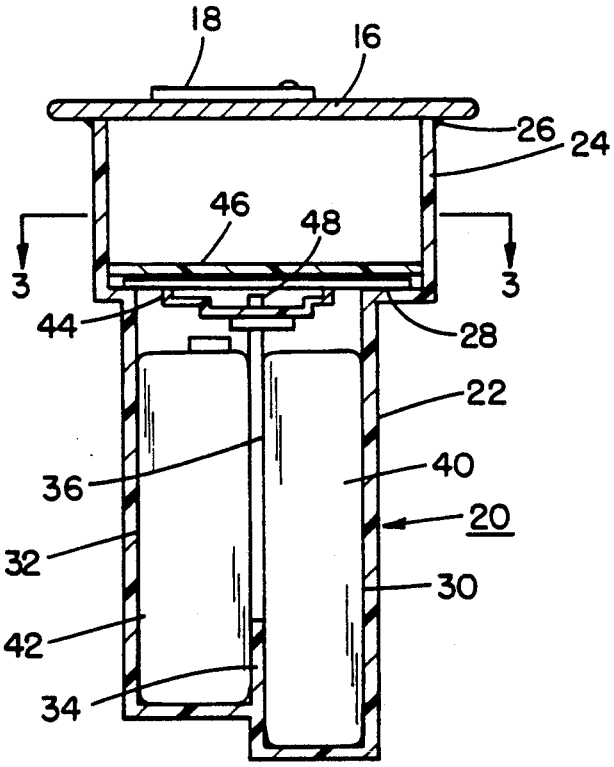
FIG. 2 illustrates a longitudinal sectional view through the sound-generating device which is housed within the container.
Figure 3:
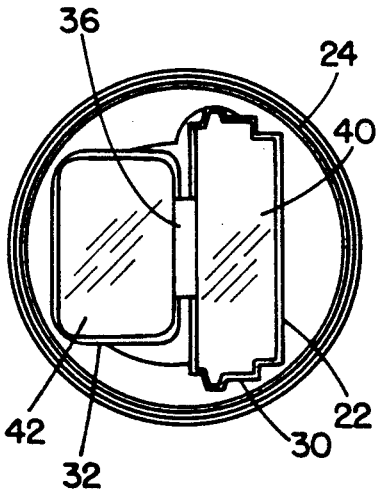
FIG. 3 illustrates a sectional view taken along line 3—3 in FIG. 2.

Referring in more specific detail to the sound-generating device 20, as shown in FIGS. 2 and 3, the device incorporates a compartmented housing structure 22, preferably formed from a rigid molded plastic material, such as polystyrene or the like, having a first generally cylindrical upper portion 24 adapted to have the upper circumferential edge 26 thereof sealingly fastened; for instance, through a suitable adhesive such as an epoxy resin, to the bottom surface of the container cover or top wall 16. The lower end of the cylindrical portion 24 includes an inwardly extending plate portion 28 from which there depends a first compartment 30 in an adjoining relationship with a second compartment 32, having a dividing wall 34 therebetween which incorporates an opening 36 to facilitate communication between the compartments 30, 32.

Figure 4:
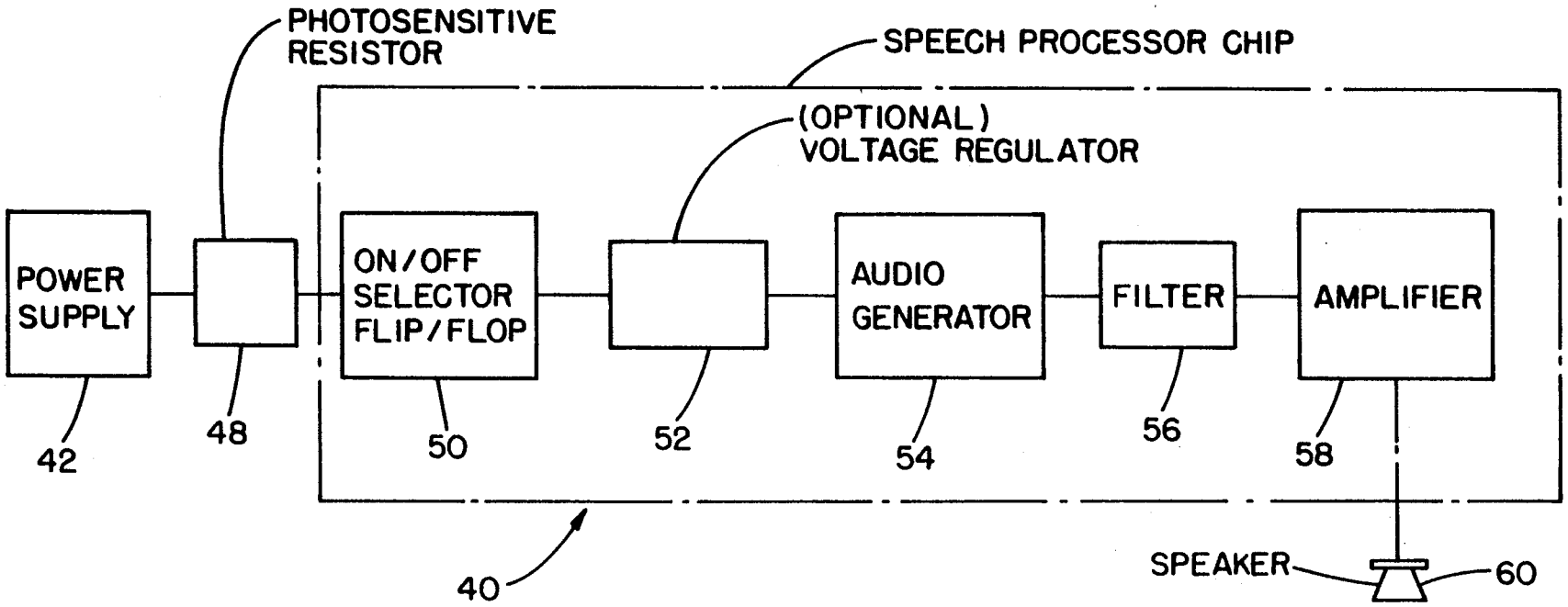
FIG. 4 illustrates a generally schematic block circuit diagram of the basic components of the sound-generating device.

Arranged at a suitable fit in the first compartment 30 are electronic components including a speech processor chip 40 having a memory and logic circuit for starting a message, as more specifically elucidated in connection with FIG. 4, whereas the second compartment 32 is adapted to fittedly receive a suitable electrical energy supply unit 42; in this instance, a suitable battery; for example, 3 volt, 4.5 volt, 6 volt or 9 volt battery as needed, which is electrically connected with the memory and logic circuit 40 across the opening 36 between compartments 30, 32.

The components 40 and 42 which are housed in the respective compartments 30 and 32 are positioned therein, may optionally be sealed with respect to the remaining space in the can 10 and the exterior surroundings through the possible superposition of a stepped closure plate 44 at the bottom of the cylindrical structure 24, which may be a component of a speaker, and when provided may be constructed of a transparent or light-permeable plastic material, and supported along its periphery on plate portion 28, and which may also optionally have a further transparent or light-permeable sealing plate 46 of plastic material superimposed thereon to ensure that there will be no fluid leakage between the outside and interior of compartments 30 and 32. In essence, the compartments 32 and 30 are hermetically sealed with respect to the other parts inside the can and the outside of the beverage can 10, so as to protect the electrical and electronic components located therein and to inhibit access thereto by a purchaser subsequent to the opening of the beverage can.

The speech processor chip 40 includes a photosensitive-element; for instance, such as photosensitive resistor, or photo transistor or Photo-Darlington 48 positioned at a location below the transparent components 44 and 46, so as to be exposed to ambient light entering the cylindrical portion 24 upon the opening of the can by the pull-tab 18 which is fastened to the cover or top wall 16.

In connection with the foregoing, reverting to the electronic speech processor chip 40 and the constituents of the sound-generating device 20 pursuant to the invention in more specific particularity, as shown in the generally schematic block circuit diagram of FIG. 4, the speech processor chip includes an on/off selector switch 50, preferably in the form of a flip/flop, which is operatively connected to the photosensitive resistor 48 and wherein the device is supplied with electrical operating power from the battery 42. The on/off selector switch or flip/flop 50 may be incorporated into the speech processor chip 40 and connected to an audio generator 54 for the formation of suitable synthesized sound sequences. Alternatively, if necessary, the selector switch may be connected with a voltage regulator 52 which, in turn, is connected to the audio generator 54. Moreover, suitable speech compression circuit, and recording and playback expansion circuit can also be provided although these functions need not be on the speech processing chip or board. The audio generator 54 may be suitably programmed to generate specific sequences and tonal sounds for a specified interval of time, such as a musical tune in the form of a so-called "jingle" related to the product in the container 10, and/or a synthesized human voice informing a purchaser who has opened the can and activated the microcomputer as to the possibility of having won or being eligible for a prize or premium. The audio generator 54 is adapted to be programmed whereby, upon the completion of a specific time interval during which a certain programmed sequence of sounds has been emitted, the on/off selector switch or flip/flop 50 will revert to its "off" position, thereby deactivating the sound-generating device 20 and concurrently terminating the flow of current from the battery 42.

The audio generator 54 is connected to the input of a suitable filter 56 in order to clarify the generated sounds and to filter out any background noise or static; the output of the filter 56 being connected to an amplifier 58 to provide for sound amplification, with the sound then being transmitted to a speaker 60, of which the stepped plate 44 may be a component. All of these components 40 and 44 through 60 are integrated and arranged in the compartment 30 within the housing 22 provided for the sound-generating device 20.

If it is desired to repeat the generation of the sound sequence which is programmed into the memory and logic circuit of the speech processor chip 40, it is merely necessary to temporarily cover the opened closure previously formed by the actuation of the pull-tab 18 so as to prevent the entry of light to the photosensitive element 48, the flip/flop or on/off selector switch 50 having been previously reverted into a state of readiness for renewed operation, as mentioned hereinbefore, and thereafter again permitting light to impinge against the photosensitive element 48; and thereby consequently repeating the sound-generating sequence as described hereinabove.

From the foregoing it becomes readily apparent that the unique sound-generating device 20 which is incorporated into the beverage can 10 allows for the novel utilization thereof in conjunction with a promotional campaign contemplated by the manufacturer of the product in the beverage can. In addition to the foregoing, the remaining space available within the beverage can 10 externally of the sound-generating device 20 may be filled with a suitable liquid, such as water, or preferably any non-toxic liquid which would be harmless if inadvertently consumed by a purchaser, which is normally permanently sealed within the beverage can and is prevented from being discharged through the opened closure formed by the actuated pull-tab 18. This presence of the liquid filling simulates the feel and weight of a normal full beverage can prior to the opening thereof by a consumer. However, in the event, that leakage is encountered which causes some of the liquid in the compartment 62 of the can exteriorly of the sound-generating device 20 to flow to the opened closure of the can and escape to the outside, the employment of a non-toxic liquid, such as water, will not produce any harmful effects in a consumer inadvertently swallowing some of the liquid.

Alternatively, it is also possible to contemplate an embodiment of the containment structure or can 10 possessing the inventive sound-generating device 20, in which the interior of the can surrounding the components of the device 20 is not filled with a liquid. Thus, it is possible to fill the remaining space within the can 10 with a suitable foam or dry filler material in order to impart rigidity thereto. Optionally, the can may also be weighted to simulate the weight, feel and appearance of an ordinary beverage can. In the instance in which a foam or dry filler material is employed in lieu of a liquid, the circuit components of the sound-generating device and the battery need not be enclosed and sealed off from the remaining interior space of the can. This, in effect, renders the entire construction even simpler and more economical in its manufacture.

While there has been shown and described what is considered to be a preferred embodiment of the invention, it will, of course, be understood that various modifications and changes in form or detail would readily be made without departing from the spirit of the invention. It is therefore intended that the invention be not limited to the exact form and detail herein shown and described, or to anything less than the whole of the invention herein disclosed as hereinafter claimed.

What is claimed is:

1. In a containment structure having at least one compartment arrangement and an openable closure communicating with said compartment arrangement; said compartment arrangement housing interiorly thereof hidden from external viewing of said containment structure, an operative arrangement comprising sound-generating means, a battery electrically connected with said sound-generating means for supplying electrical energy to said means, and light-activated switch means including a photosensitive element connected to said sound-generating means for initiating the generating of sounds for a predetermined time interval responsive to opening of said closure enabling ambient light to impinge against said switch means for actuating said sound-generating means, said sound-generating means including means for deactivating said switch means upon completion of said time interval so as to terminate the generation of said sounds whereby shielding of said light-activated switch means from exposure to light and upon subsequent reexposure of said switch means to light reactivates said sound-generating means for a subsequent time interval for initiating a repeated generation of said sounds.

2. A structure as claimed in claim 1, wherein said photosensitive element comprises a photosensitive resistor.

3. A structure as claimed in claim 1, wherein said photosensitive element comprises a photo transistor.

4. A structure as claimed in claim 1, wherein said photosensitive element comprises a Photo-Darlington.

5. A structure as claimed in claim 1, wherein said sound-generating means comprises a speech processor chip incorporating circuits for emitting programmed synthesized sounds.

6. A structure as claimed in claim 1, wherein said photosensitive element is responsive to low-intensity ambient light impinging thereagainst so as to activate said switch means.

7. A structure as claimed in claim 1, wherein a transparent cover member sealingly covers said compartment arrangement facing said openable closure so as to hermetically seal the contents of said compartment arrangement while facilitating the contact of said light-activated switch means by ambient light upon opening of said closure.

8. A structure as claimed in claim 7, wherein said transparent cover member is constituted from a plastic material.

9. A structure as claimed in claim 1, wherein said compartment arrangement includes a sealing structure constituted from a rigid plastic material and is sealingly fastened to an internal wall surface of the closure.

10. A structure as claimed in claim 1, wherein the interior of said containment structure is filled with a foam or dry filter material.

11. A structure as claimed in claim 1, wherein said containment structure is weighted to impart the weight, appearance and feed of a filled beverage container thereto.

12. A structure as claimed in claim 1, wherein said containment structure includes a sealed compartment shielded from the electrical components in said containment structure which is filled with a liquid.

13. A structure as claimed in claim 12, wherein said liquid is a non-toxic liquid.

14. A structure as claimed in claim 12, wherein said containment structure is a generally cylindrical beverage container.

15. A structure as claimed in claim 14, wherein said beverage container is a metallic or plastic can, and said openable closure includes a pull-tab opening arrangement.

* * * * *